US005410799A

United States Patent [19]

Thomas

[11] Patent Number: 5,410,799

[45] Date of Patent: May 2, 1995

[54] METHOD OF MAKING ELECTROSTATIC SWITCHES FOR INTEGRATED CIRCUITS

[75] Inventor: Michael E. Thomas, Milpitas, Calif.

[73] Assignee: National Semiconductor Corporation, Santa Clara, Calif.

[21] Appl. No.: 32,615

[22] Filed: Mar. 17, 1993

[51] Int. Cl.[6] ..... H01H 11/00

[52] U.S. Cl. ..... 29/622; 29/829; 200/181

[58] Field of Search ..... 29/622, 829; 200/181

[56] References Cited

U.S. PATENT DOCUMENTS

| | | | |
|---|---|---|---|
| 2,927,255 | 3/1960 | Diesel | 200/181 |
| 3,566,457 | 3/1971 | Engler | 29/832 |
| 3,681,134 | 8/1972 | Nathanson et al. | 29/829 |
| 4,320,572 | 3/1982 | Brower et al. | 29/622 |
| 4,674,180 | 6/1987 | Zavracky et al. | 29/622 |
| 5,121,089 | 6/1992 | Larson | 200/181 |
| 5,258,591 | 11/1993 | Buck | 200/181 |

*Primary Examiner*—P. W. Echols

*Attorney, Agent, or Firm*—Stephen R. Robinson; William H. Murray

[57] ABSTRACT

The first electrical switch contact of an electrostatic switch is formed over a substrate. A layer of electrically insulating material is interposed between the first switch contact and the substrate where the substrate is a silicon substrate having active regions. In that case, contact holes are formed in the insulating layer where desired to form electrical contact between the first switch contact and an underlying active region. An electrically insulating layer is formed over the first switch contact. A second switch contact is formed over the electrically insulating layer in a position such that a middle portion of the second electrical contact overlies a middle portion of the first electrical contact. A void is then created between the middle portions of the two electrical contacts by removing a portion of the electrically insulating material there between. The switch is operable by applying an electrical potential between the electrical contacts such that the middle portion of at least one of the electrical contacts deflects toward the middle portion of the other whereby electrical contact is created between the two.

8 Claims, 12 Drawing Sheets

METHOD OF MAKING ELECTROSTATIC SWITCHES FOR INTEGRATED CIRCUITS

BACKGROUND OF THE INVENTION

This invention relates to integrated circuits and more particularly to electromechanical switches for integrated circuits.

Integrated circuits are typically fabricated with fixed wiring schemes for interconnecting the various integrated circuit devices. Because these wiring schemes are fixed, functional versatility dictates that more devices are required than wold be the case if the electrical connections were programmable. These excess device requirements consume extremely valuable real estate on the integrated circuit. Accordingly, it is desirable to construct a physical interconnect structure on an integrated circuit which allows programmable wiring schemes. Such programmable wiring schemes could also be useable for making programable multi-chip interconnects; trimming links for high precision digital to analog converters and programmable nonvolatile memories among other applications.

SUMMARY OF THE INVENTION

An electrostatic switch for integrated circuits includes a first electrical contact means formed on an integrated circuit. A second electrical contact means, is formed in proximal spaced relationship with respect to the first contact means. An electrical potential is applied between the first and second electrical contact means which causes at least one of the electrical contact means to deflect toward and electrically contact the other electrical contact means as a result of electrostatic forces imparted by the potential difference applied.

In one embodiment, one of the electrical contact means comprises a cantilevered metal strip mechanically attached at one end to the integrated circuit. The unattached end of the metal strip is positioned in proximal spaced relation with respect to the other electrical contact means. Application of the potential difference between the two electrical contact means causes the unattached end of the cantilevered metal strip of the one electrical contact means to deflect toward and into electrical contact with the first electrical contact means as a result of electrostatic forces imparted.

In an alternate embodiment, at least one of the electrical contact means comprises a strip of electrically conductive material which is mechanically attached at both ends to the integrated circuit. At least a portion of the metal strip intermediate the ends is disposed intermediate and spaced from adjacent electrical contact means. Application of the potential difference between the electrical contact means causes the portion of the one electrical contact means intermediate the ends thereof to deflect toward and into electrical contact with the other electrical contact means as a result of the applied electrostatic forces.

Another embodiment takes the form of a single pole double throw switch. In this embodiment, one of the electrical contact means comprises a strip of electrically conductive material which is mechanically attached at both ends to a substrate, preferably the substrate of an integrated circuit. At least a portion of the metal strip intermediate the ends is disposed intermediate and spaced from adjacent electrical contact means. Application of the potential difference between the middle electrical contact means and one of the adjacent electrical contact means causes the portion of the middle electrical contact means intermediate the ends thereof to deflect forward and into electrical contact with the one electrical contact means as a result of the applied electrostatic forces. In this embodiment, the potential applied between the middle electrical contact means and one of the adjacent electrical contact means can also be repulsive in nature thereby causing the middle contact means to deflect away from the one adjacent electrical contact means toward and into contact with the other adjacent electrical contact means.

In yet another alternate embodiment, each of the electrical contact means comprises a strip of electrical conductive material which is mechanically attached at both ends to the integrated circuit but is free to deflect in the middle. At least a portion of the metal strip intermediate the ends of each is disposed in proximal spaced relationship with respect to the other. Application of the potential difference between the electrical contact means causes the portion of each electrical contact means intermediate the ends thereof to deflect toward and into electrical contact with the portion of the other electrical means intermediate the ends thereof as a result of the applied electrostatic forces.

DETAIL DESCRIPTION OF THE INVENTION

Figure 1A:
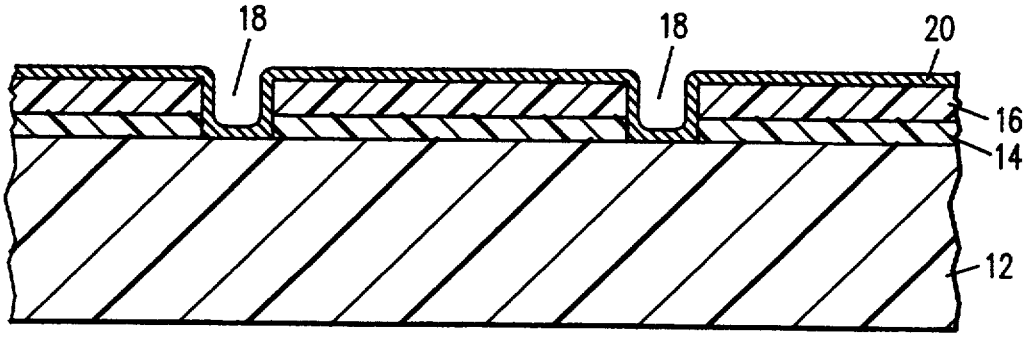
FIGS. 1A through 1I depict diagrammatic cross-sectional views of stages of fabrication of a preferred embodiment of an electrostatic switch in accordance with the present invention.

Referring to FIGS. 1A through 1H there is shown, in diagrammatic cross-sectional view, various stages of fabrication of an electrostatic switch for integrated circuits in accordance with a preferred embodiment of the present invention. An etch stop layer 14 is formed over a silicon substrate 12. In the preferred embodiment, the etch stop layer 14 comprises silicon nitride which formed preferably by a CVD process as is known in the art, preferably to a thickness of approximately 1 micron. An electrically insulating layer 16 is formed over the layer 14. In the preferred embodiment, the electrically insulating layer 16 comprises silicon dioxide which is preferably formed by a CVD process as is known in the art, to a thickness which is preferably approximately 5,000 Å. Contact holes 18 are formed through the layers 16 and 14 to expose underlying contact areas on the silicon substrate. The contact holes 18 are defined by conventional photoresist techniques and are opened through the layers 16 and 14 using an etchant which, in the preferred embodiment, is a dry fluorinated plasma for example $CHF_3$ and oxygen.

Although the following detailed description is directed to embodiments where the electrostatic switches are fabricated on a semiconductor substrate having active regions which are accessed through contact holes, it is within the scope and contemplation of the present invention to fabricate the electrostatic switches on any type of rigid substrates such as, for example, silicon or printed circuit board material. In such embodiments where the substrate is an electrically insulating material, it would not be necessary to utilize the electrically insulating layer 16.

A thin electrically conductive adhesion layer 20 is formed over the upper surface of the layer 16 into the contact holes 18 making electrical contact with the exposed contact areas on the substrate 12. In the preferred embodiment, the adhesion layer comprises a titanium tungsten alloy which is formed by sputtering as is known in the art to a thickness preferably of approximately 200 Å.

Figure 1B:
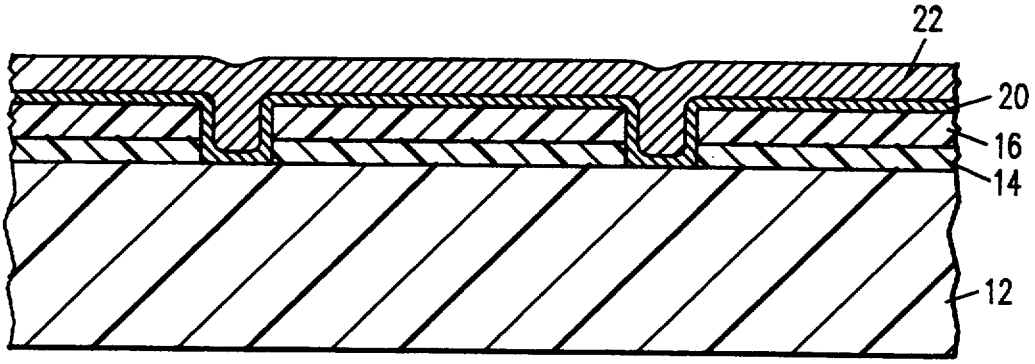

Referring now to Figure 1B, a layer 22 of electrically conductive material is formed over the adhesive layer 20 into the contact holes 18. In the preferred embodiment, the electrically conductive layer 22 comprises tungsten which is preferably formed by a CVD process as is known in the art to a thickness, preferably of approximately 5,000Å. It should be noted that the adhesion layer is not necessary if the deposition technique utilized generates sufficient adhesion of the conductive layer 22 to the dielectric layer 16. This would simplify the structure by eliminating the adhesion layer and such a structure is deemed to be within the scope and contemplation of the present invention.

Figure 1C:
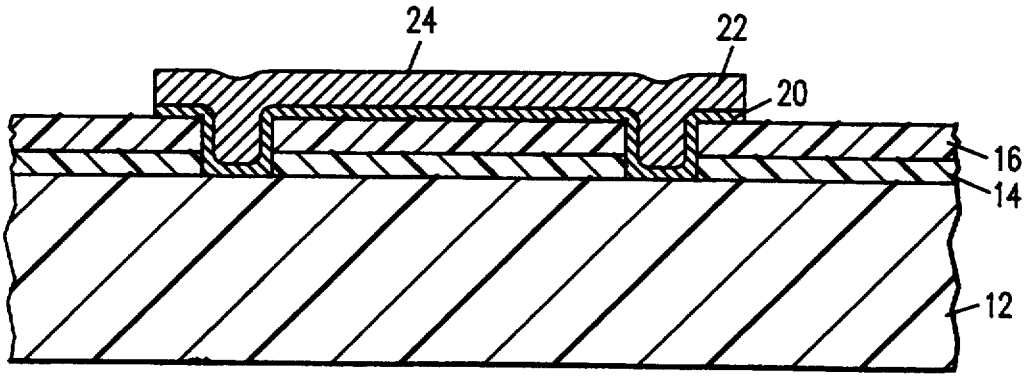
Figure 1D:
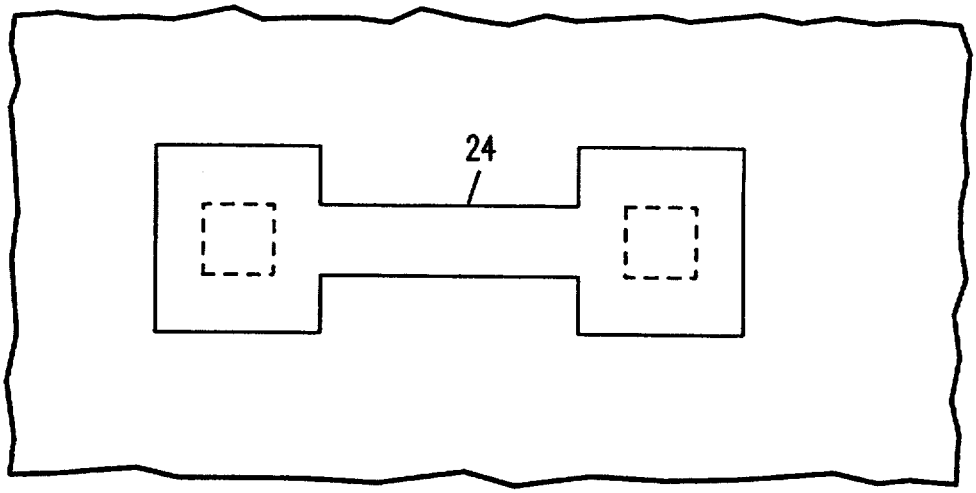

The electrically conductive layer 22 is patterned and etched as shown in FIGS. 1C and 1D using conventional photoresist techniques to form a first switch contact 24. The etchant is preferably an $SF_6$ and argon dry etch if the features are very small and $H_2O_2$ and water for larger features which can tolerate isotropic etching. Such etchants etch the tungsten material of the electrically conductive layer 22 and the titanium tungsten alloy material of the adhesion layer 20 but will stop on the silicon dioxide layer 16.

Figure 1E:
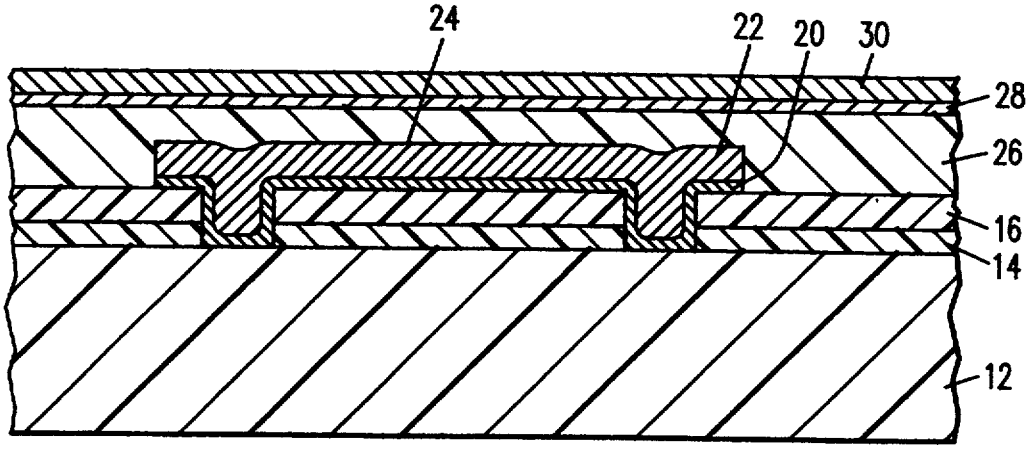

Referring to FIG. 1E, an interlevel dielectric layer 26 is disposed over the electrically insulating layer 16 and the first switch contact 24. In the preferred embodiment, the first interlevel dielectric comprises silicon dioxide which is preferably formed by a CVD process as is known in the art to a thickness in the range of 500 Å to 20,000 Å, preferably 500 Å.

Following deposition and levelling of the interlevel dielectric layer 26, a second adhesion layer 28 is formed over layer 26. In the preferred embodiment, the second adhesion layer 28 comprises a titanium-tungsten alloy which is preferably formed by sputtering as is known in the art to a thickness which is preferably 200 Å. A second layer 30 of electrically conductive material is formed over the second adhesion layer 28. In the preferred embodiment, the second electrically conductive layer 30 comprises tungsten which is formed, preferably via a CVD process, to a thickness which is preferably approximately 5,000 Å.

As previously stated, the adhesion layer 28 is interposed between layers 26 and 30 when using a CVD process. As also previously stated, it is possible, as is known in the art, to put down conductive films on a dielectric with good adherence. In such cases, an adhesion layer is not necessary which would then eliminate the need for layers 20 and 1 or 28 FIG. 1. The second electrically conductive layer 30 is formed into a second switch contact 32 as shown in FIGS. 1F and 1G using conventional photoresist techniques and an etchant which etches the materials of the second electrically conductive layer 30 and second adhesion layer 28 but etches the material of the interlevel dielectric layer 26 much more slowly as is known in the art.

Figure 1F:
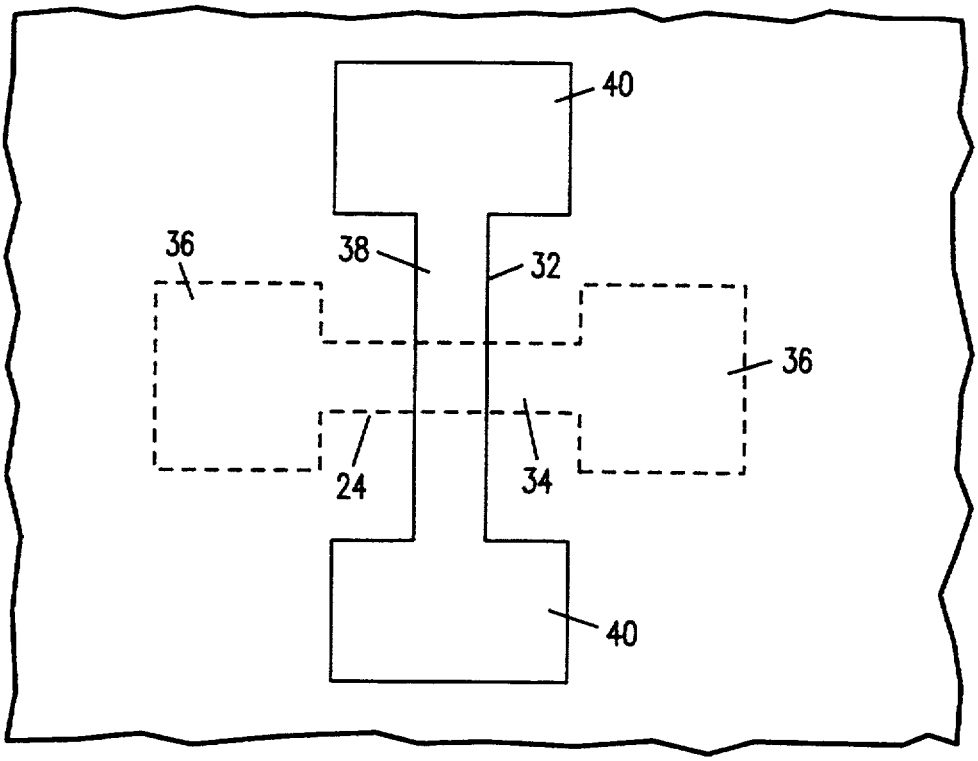
Figure 1G:
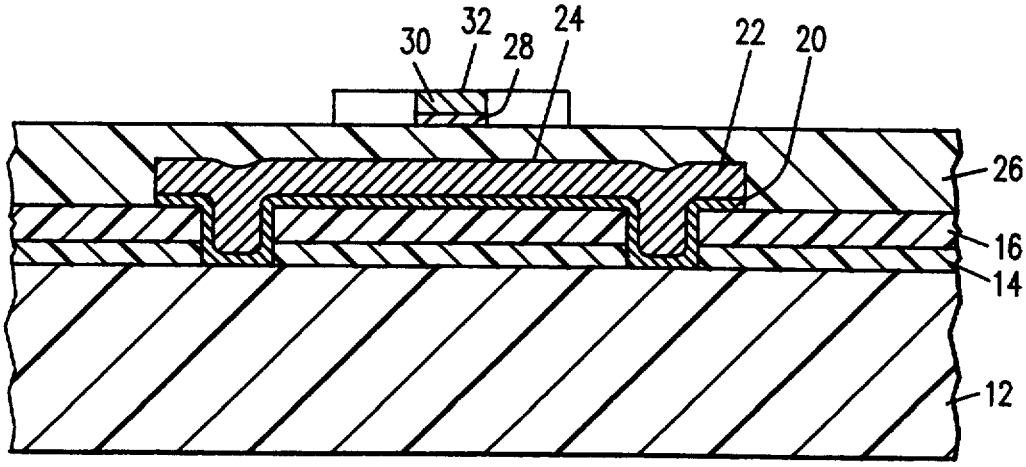

In the preferred embodiment of the present invention depicted in FIGS. 1F and 1G, each contact of the electrostatic switch is substantially in the shape of a dumbbell (sometimes referred to as a dog bone). The first switch contact 24 comprises a strip 34 of the first metal which expands out to contact areas 36 at each end. The second switch contact 32 comprises a strip 38 of the second metal which expands out to contact areas 40 at each end.

Figure 1H:
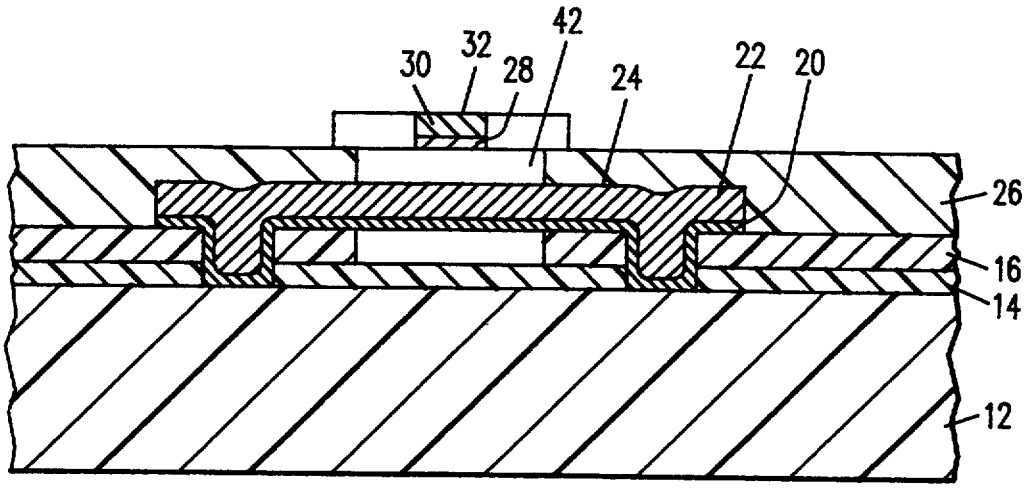
Figure 1I:
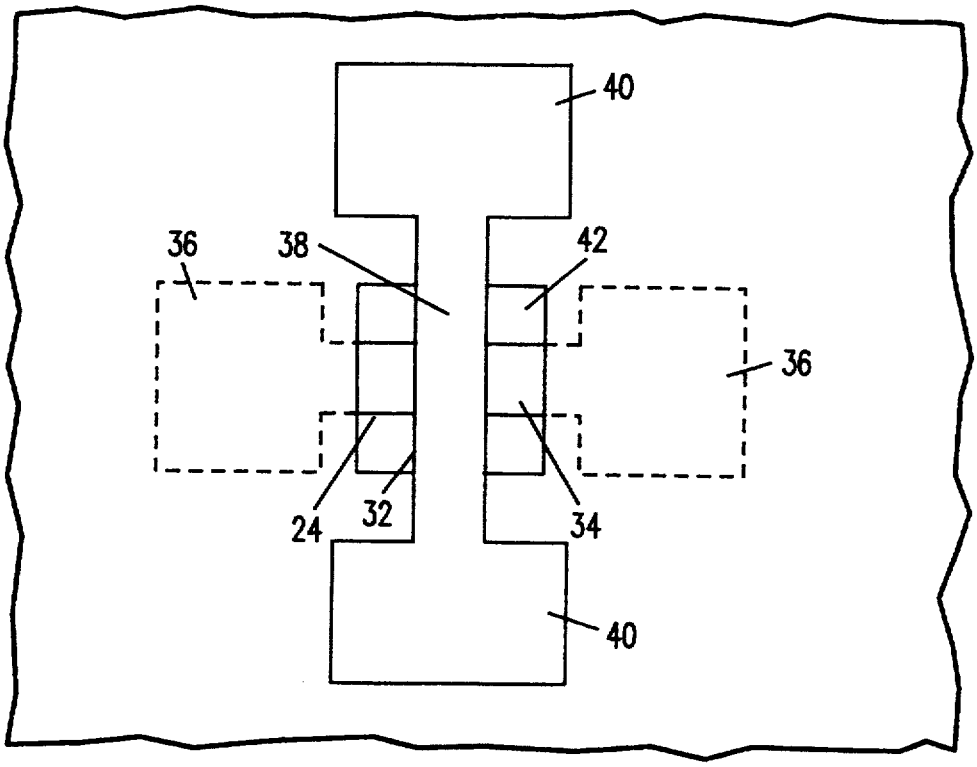

Referring now to FIGS. 1H and 1I, a void 42 is formed in the interlevel dielectric layer 26 and electrically insulating layer 16 using conventional photoresist and etch techniques. In the preferred embodiment, the etchant is either 10:1 water to HF or buffered oxide etch which attacks the silicon dioxide material of the layers 26 and 16 but is substantially unreactive with the material in the electrically conductive and adhesion layers of the first 24 and second 32 switch contacts.

Referring now to FIGS. 2A through 2G there is shown, in diagrammatic cross-sectional view, various stages of fabrication of an electrostatic switch for integrated circuits in accordance with an alternative preferred embodiment of the present invention. In the preferred embodiment described above in connection with FIGS. 1A through 1H, the strip portion of each of the switch contacts is floating since it is not supported by surrounding material. In the alternate preferred embodiment which will be described in connection with FIGS. 2A through 2G only the strip portion of the second contact is floating since the strip portion of the first contact is supported by and rigidly attached to the etch stop layer formed over the substrate as will be described.

Figure 2A:
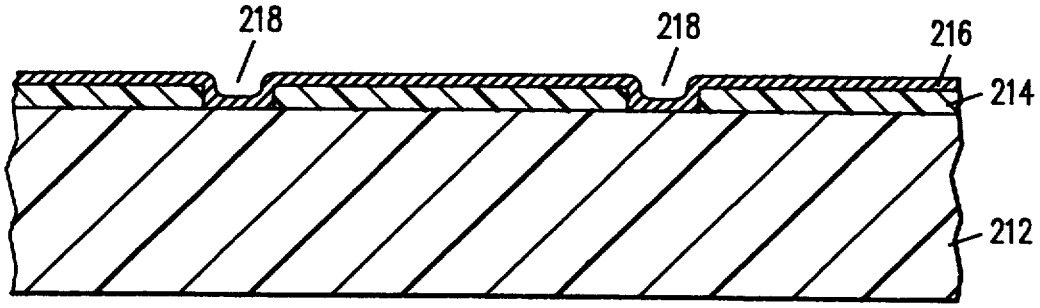
FIGS. 2A through 2G depict diagrammatic cross-sectional views of stages of fabrication of an alternate preferred embodiment of an electrostatic switch in accordance with the present invention.

Referring now to FIG. 2A, a first electrically insulating layer 214 is formed over the substrate 212. The material of the first electrically insulating layer 214 is PREFERABLY SILICON NITRIDE and the process by which it is formed over the substrate 212 is the same as that described previously in connection with the first embodiment where the electrically insulating layer 214 is formed directly on the surface of the substrate 212. Contact holes 218 are formed in the first electrically insulating layer 214 to expose contact areas on the underlying substrate 212. In the preferred embodiment, the contact holes 218 are formed as were the contact holes 18 in the previous description of the other preferred embodiment. The materials and processes used in the remaining portion of this detailed description of the alternate preferred embodiment are the same as comparable materials and processes described in connection with the previously described embodiment.

Figure 2B:
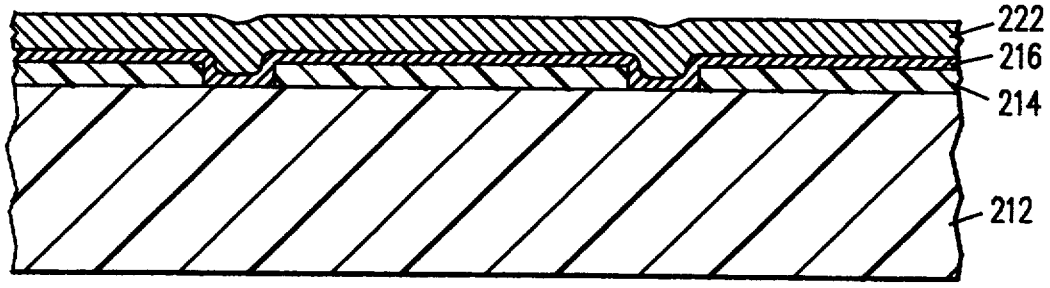
Figure 2C:
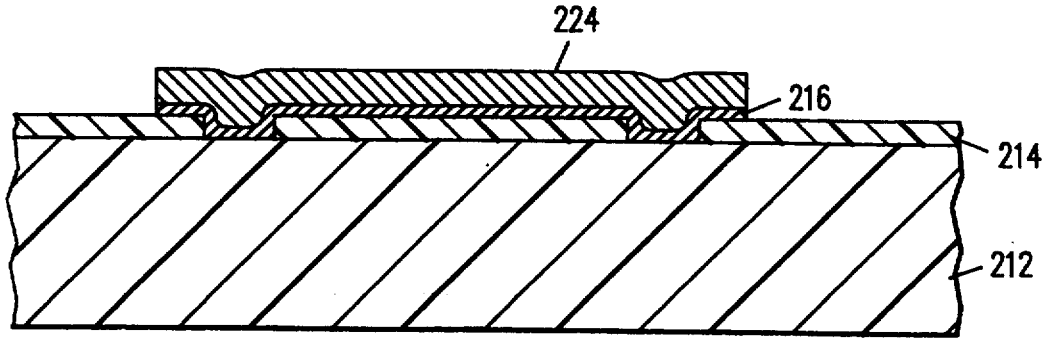
Figure 2D:
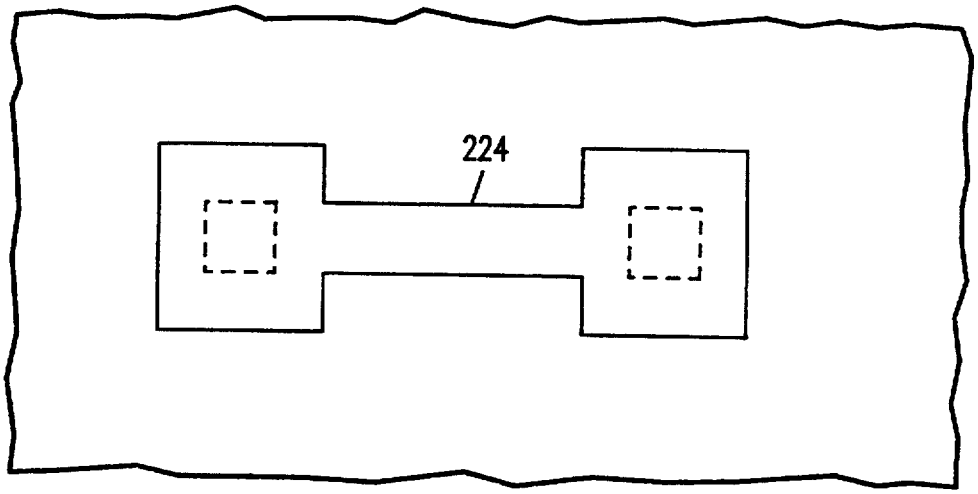

A first adhesion layer 216 is formed over the first etch stop layer 214 into the contact holes 218 and in electrical contact with the underlying contact areas of the substrate 212. As shown in FIG. 2B, a first electrically conductive layer 222 is formed over the first adhesion layer 216. The first electrically conductive layer 222 and first adhesion layer 216 are formed into a first switch contact 224 as shown in FIGS. 2C and 2D.

Figure 2E:
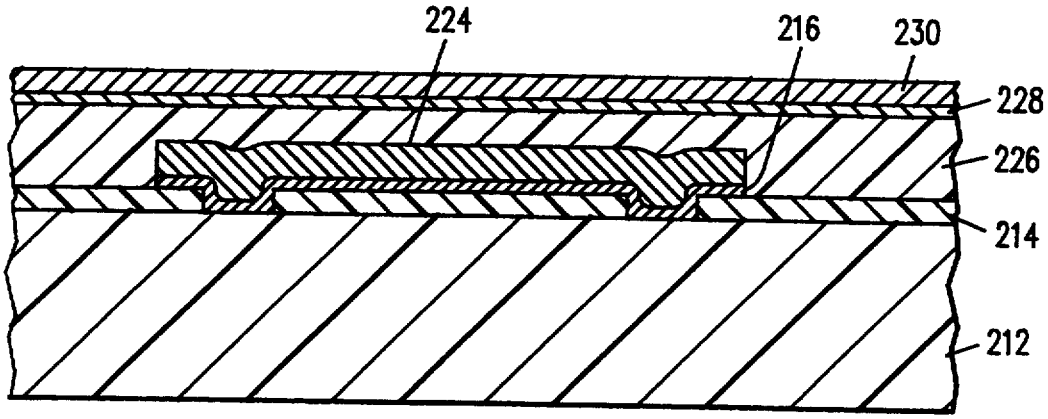

Referring to FIG. 2E, a layer 226 of dielectric material is formed over the first switch contact 224 and the first etch stop layer 214. In the preferred embodiment, the electrically insulating layer 226 comprises silicon dioxide. A second adhesion layer 228 and a second electrically conductive layer 230 are formed over the dielectric layer 226. As noted above, with respect to the description of the previous embodiment, the use of adhesion layers 216 and 228 are preferred when using CVD processing.

Figure 2F:
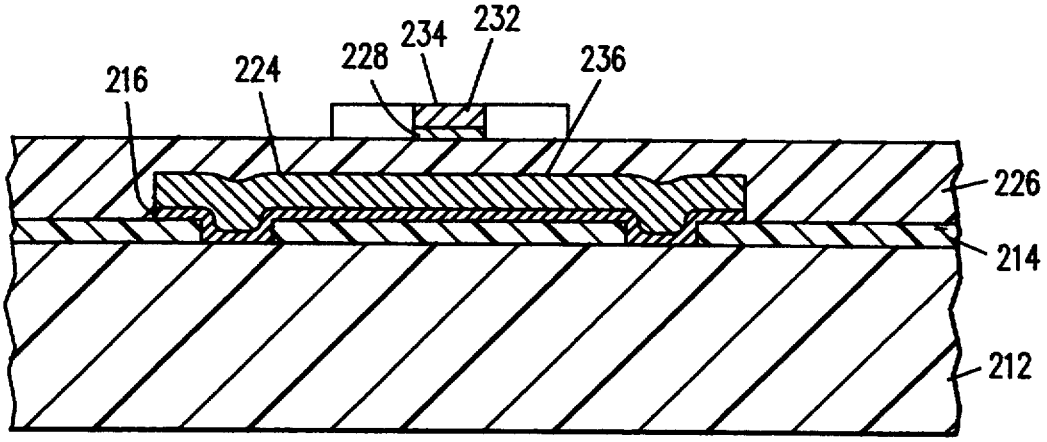

Referring now to FIG. 2F, the second adhesion 228 and electrically conductive 230 layers are formed into a second switch contact which has a middle portion 234 which in a preferred embodiment is in substantially orthogonal overlying relationship with the middle portion 236 of the first switch contact 224 as shown, for example, in FIG. 1F. It should be noted that it is not necessary that the overlying relationship be orthogonal. The switch contacts can have any predetermined angular relationship between them from parallel to orthogonal.

Figure 2G:
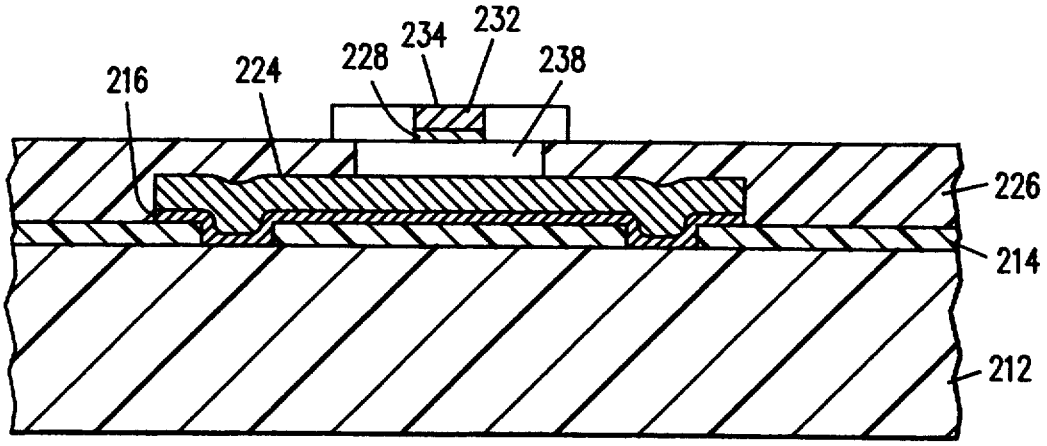

Referring now to FIG. 2G, a void 238 is formed in the electrically insulating layer 238 using conventional photoresist and etch techniques as were previously described in connection with the embodiment described above. The void 238 is located under the middle portion 234 of the upper switch contact 236 and is oriented with respect to the upper switch contact 232 as shown, for example, in FIG. 1I Referring now to FIGS. 3A through 3F, there is shown, in diagrammatic cross-sectional view, various stages of fabrication of a single pole double throw electrostatic switch for integrated circuits in accordance with a preferred embodiment of the present invention. A middle switch contact 312 (the pole in this embodiment) is formed having a middle portion 314 which is in substantially orthogonal overlying relationship with respect to a middle portion 316 of a lower switch contact 318 as described in connection with FIGS. 2A through 2F. A second dielectric layer 320, preferably comprised of silicon dioxide, is formed over the first dielectric layer 322. A third electrically conductive layer 324, preferably comprising tungsten, is formed over the second dielectric layer 320. A third adhesion layer 326, preferably comprising a titanium-tungsten alloy is formed over the third electrically conductive layer 324.

Figure 3A:
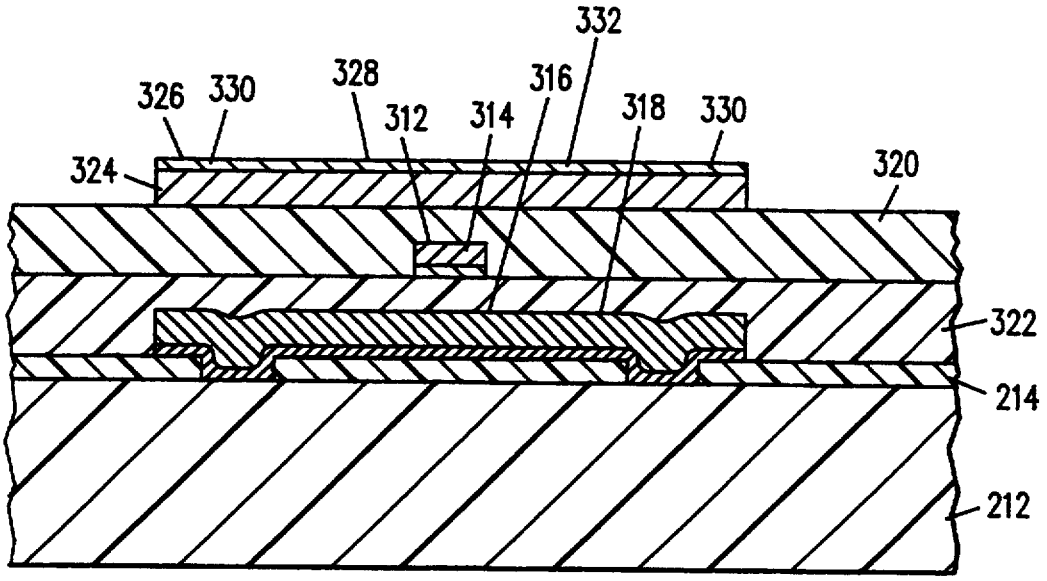
FIGS. 3A through 3F depict diagrammatic cross-sectional views of stages of fabrication of a preferred embodiment of a single pole double throw electrostatic switch in accordance with the present invention.
Figure 3B:
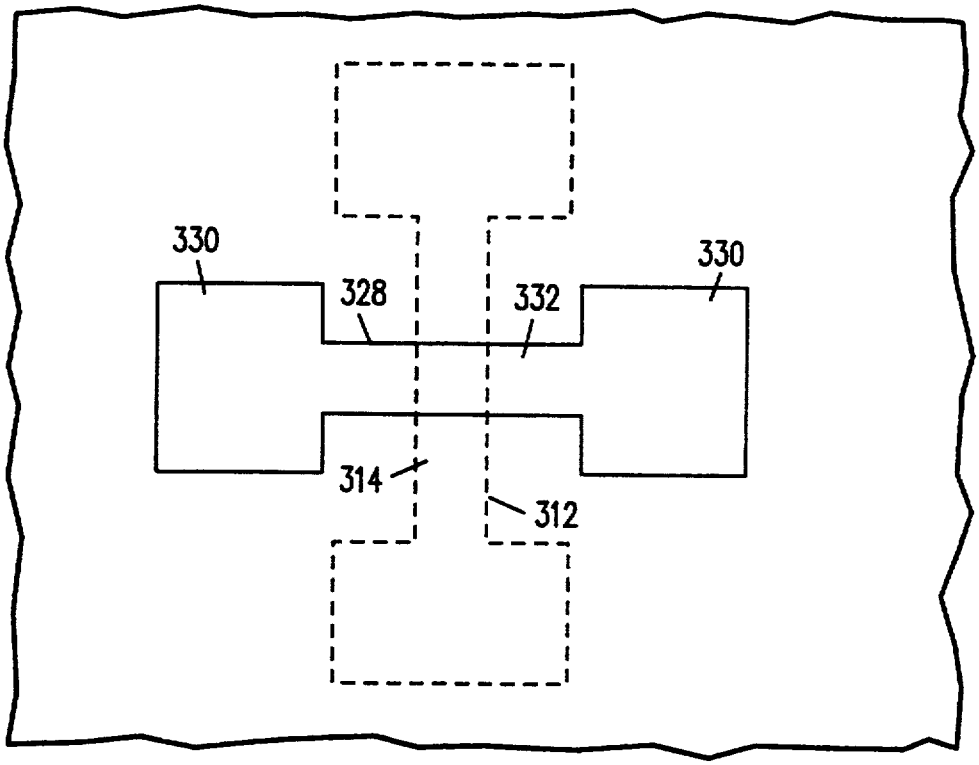

The third electrically conductive layer 324 and third adhesion layer 326 are formed into an upper switch contact 328 using conventional photoresist, masking and etching techniques, using an etchant which attacks the materials of the layers 324 and 326 but which is substantially unreactive with the material of layer 320. The upper switch contact 328 preferably has a dumbbell (or dog bone) shape with expanded end portions 330 and a middle portion 332 as shown in FIG. 3B. The middle portion 332 of the upper switch contact 328 overlies the middle portion 314 of the middle contact 312 in substantially orthogonal relationship as shown in FIG. 3B.

Figure 3C:
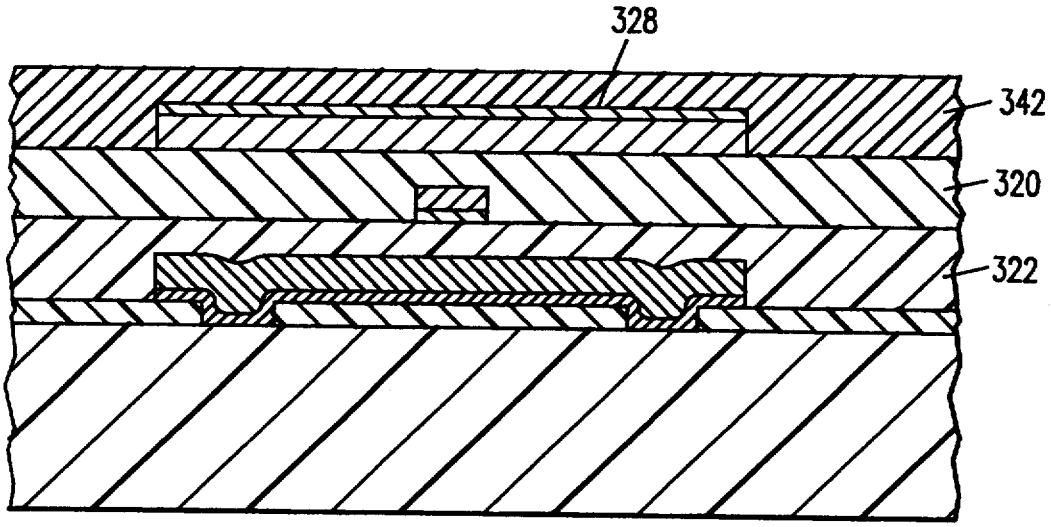
Figure 3D:
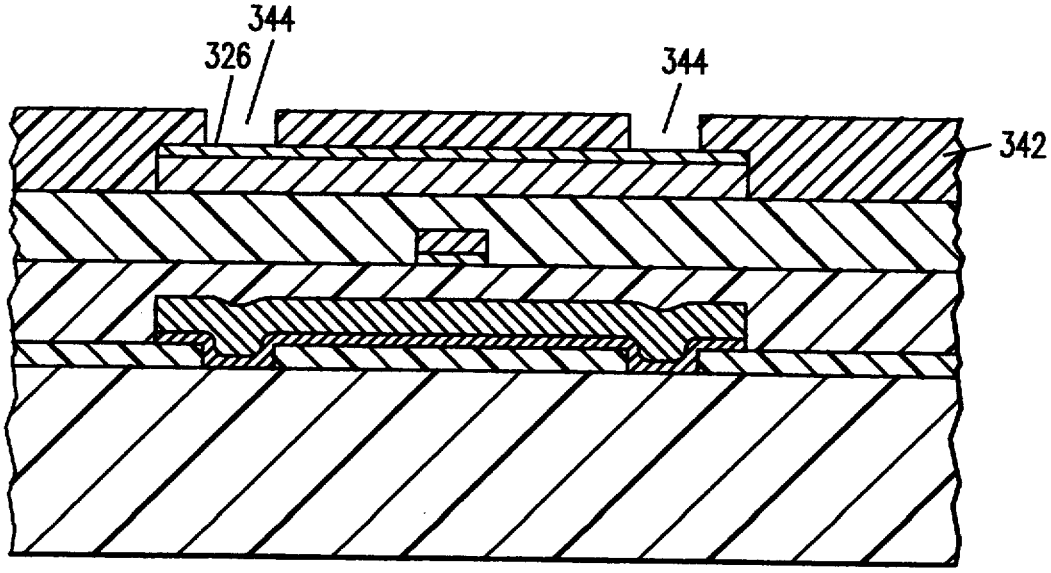
Figure 3E:
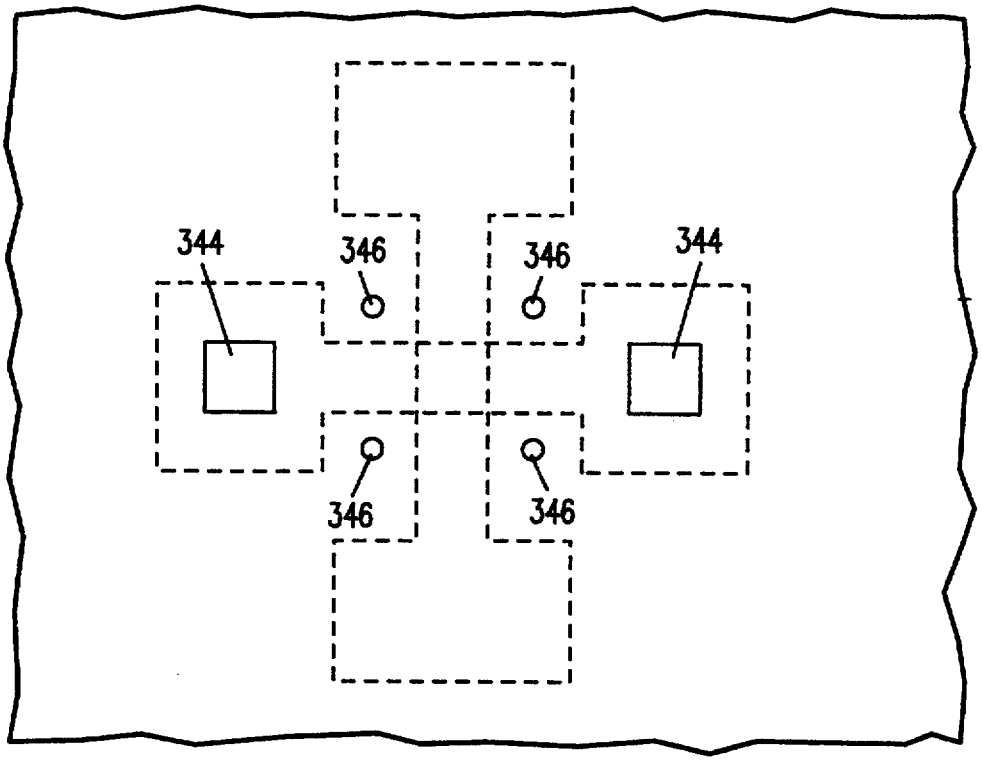
Figure 3F:
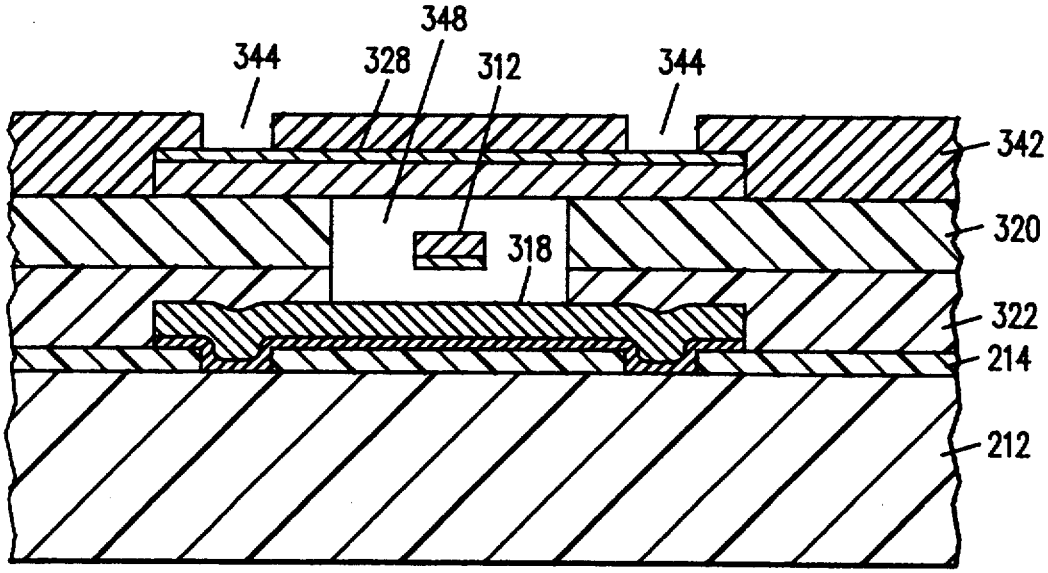

Referring to FIG. 3C, a third electrically insulating layer 342 is formed over the second electrically insulating layer 320 and the upper switch contact 328. In the preferred embodiment, the third electrically insulating layer 342 comprises silicon nitride. Holes 344 are opened in the third electrically insulating layer using conventional photoresist, masking and etching techniques, the etchant being the type which reacts with the silicon nitride material of the third insulating layer 342 at a more rapid rate than it reacts with the titanium-tungsten alloy material of the third adhesion layer 326 or the tungsten material of the third electrically conductive layer 324 or both. At the same time, small apertures 346 are opened in the third electrically insulating layer 342 down to the second electrically insulating layer 320 as shown in FIG. 3E. As shown in FIG. 3F, a void 348 is created in the first 322 and second 320 electrically insulating layers using an etchant which is introduced through apertures 346 and which reacts with the silicon dioxide material of the layers 320 and 322 and which is substantially unreactive with the materials of the third insulating layer 342 as well as the lower switch contact 316, the middle switch contact 312 and the upper switch contact 328. The middle contact 312 is floating since it is surrounded by the void 348.

Figure 4:
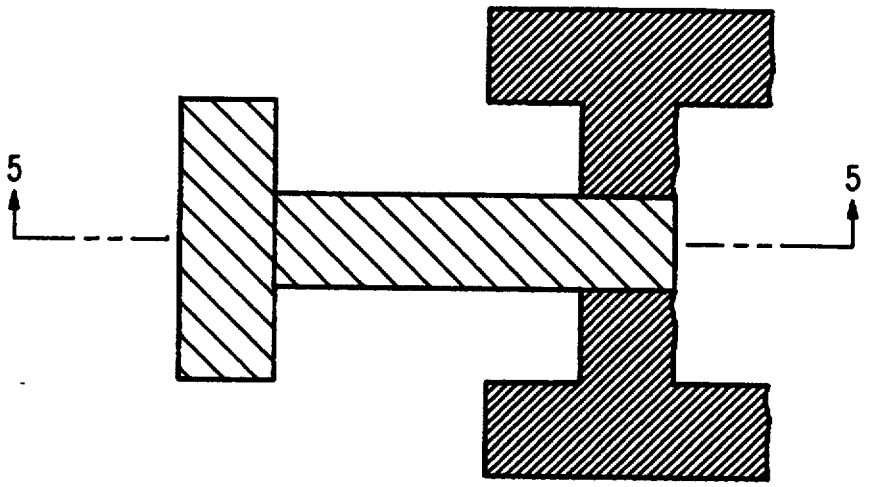
FIG. 4 diagrammatically depicts a top view of a preferred embodiment of an electrostatic switch in accordance with the present invention where one of the electrical contacts is a cantilevered metal strip.
Figure 5:
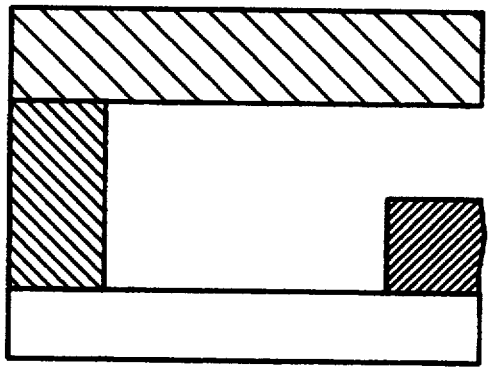
FIG. 5 is diagrammatic cross-section taken along lines 5—5 of FIG. 4.

Referring now to FIGS. 4 and 5, there is diagrammatically depicted an alternate preferred embodiment of the present invention where one of the electrical contacts is a cantilevered metal strip. This embodiment may be constructed as a single pole, single throw switch in accordance with the previous detailed description regarding FIGS. 2A through 2G; or it may be constructed as a single pole double throw switch in accordance with the previous detailed description regarding FIGS. 3A through 3F. In both of these embodiments, the cantilevered metal strips serve as the movable pole portion of the switch.

Figure 6:
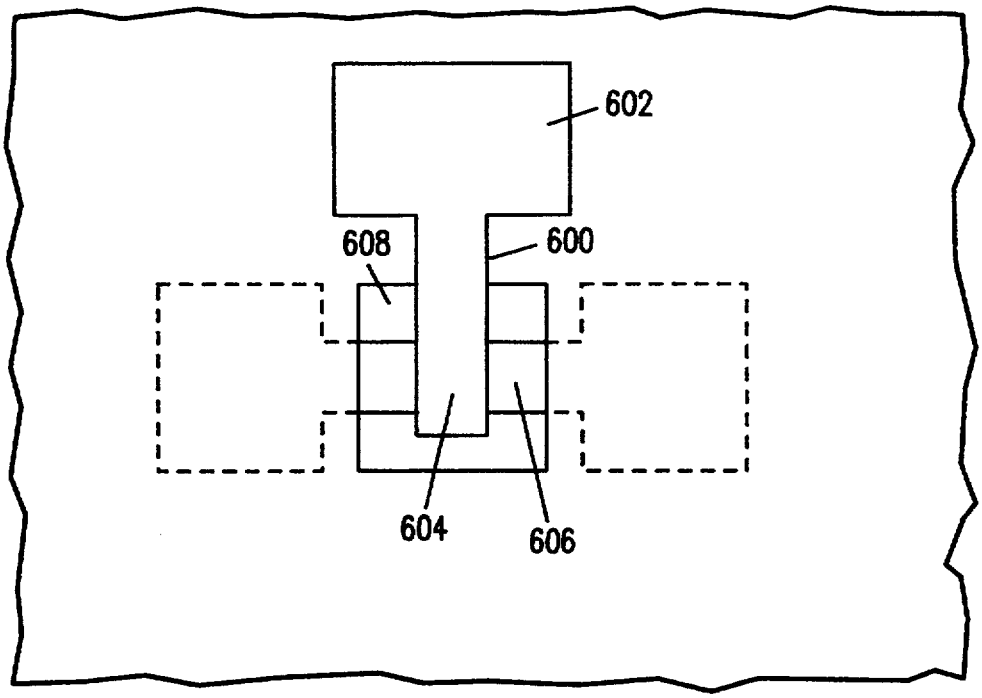
FIG. 6 depicts a top view of the preferred embodiment of an electrostatic switch in accordance with the present invention where one of the electrical contacts is a cantilevered metal strip which forms the pole of a single pole single throw switch.

The single pole, single throw version of the electrostatic switch of the present invention, having a cantilevered metal strip as the pole, is preferably constructed in accordance with the previous detailed description regarding FIGS. 2A through 2E. However, when forming the second switch contact, which will be the cantilevered pole in this embodiment, a middle portion 600 will be defined and formed such that it has a contact region 602 at one end only as shown, for example, in FIG. 6, with the region 604 adjacent the other end in overlying relationship with the middle portion 606 of the underlying switch contact.. A void 608 is then formed between the two middle portions 600 and 606 preferably in accordance with the method for forming the void 238 as set forth in the previous detailed description.

Figure 7:
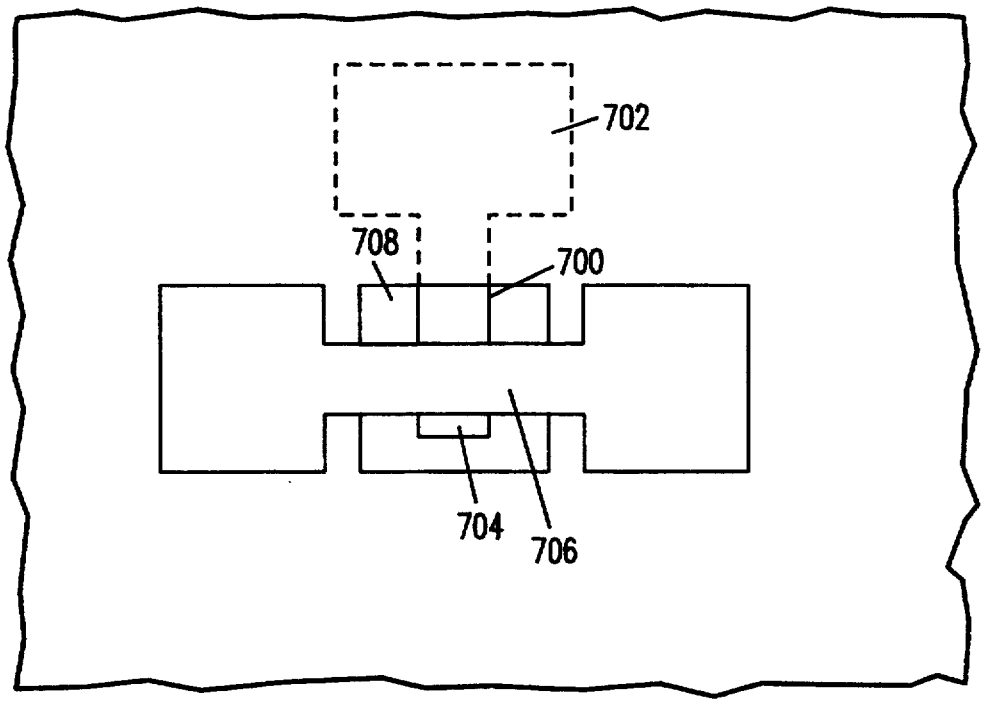
FIG. 7 depicts the top view of the alternate preferred embodiment of an electrostatic switch in accordance with the present invention where one of the electrical contacts is a cantilevered metal strip which forms the pole of a single pole double throw switch.

The single pole, double throw version of the electrostatic switch of the present invention having a cantilevered metal strip as the pole is preferably constructed in accordance with the previous detailed description regarding FIGS. 3A through 3F. However, instead of the middle switch contact 312 having contact areas at each end as shown in FIG. 3B, the middle portion 700 (See FIG. 7) of the middle switch contact, or pole in this embodiment, is defined and formed such that it has a contact region 702 at one end only with the region 704 adjacent the other end in overlying relationship with the middle portion (not shown) of the lower switch contact and the middle portion 706 of the upper switch contact. A void 708 is then formed between the middle portion of the lower switch contact, the middle portion 600 of the cantilevered pole and the middle portion 606 of the upper switch contact, preferably in accordance with the method for forming the void 348 as set forth in the previous detailed description.

The operation of the electrostatic switch in accordance with the present invention is as follows. This operation is applicable to all of the embodiments described in the detailed description above. In other words, this operation is applicable to electrostatic switches in accordance with the present invention having a single pole, single throw configuration or a single pole, double throw configuration where the pole and switch contacts are secured at both ends; as well as single pole single throw and single pole double throw switches where the pole has a cantilevered configuration.

A potential is applied between the pole and a switch contact. In the preferred embodiment, this potential is as low as 25 volts if the spacing between the pole and the switch contact is on the order of 500 Å. Lower voltage operation can be employed with larger electrode spacings when longer floating metal conductors or lower modulus metals are used in the fabrication of these structures. The applied potential creates electrostatic forces between the pole and the switch contact causing the metal strip portion of the pole and the metal strip portion of the switch contact to deflect toward each other into contact in those embodiments where the middle portions are anchored at each end; and will cause the metal strip portion of the pole to deflect toward and into contact with the switch contact in those embodiments where the switch contact is secured along its length or where the pole is cantilevered. As previously stated, the voltage applied between the electrical contacts is high enough to create electrostatic forces sufficient to deflect the strip portion of the pole into electrical contact with the strip portion of the switch contact. The force between the intersecting bridges can be described by the parallel plate capacitor. Fringe fields will be ignored. Where $$F = \frac{Q^2}{2E_0A} = \frac{E_0A}{2}\ \frac{v^2}{d^2} \qquad \text{(A)}$$

where

A=overlap area of metal 1/metal 2.

$E_O$=susceptibility $8.85\times15^{12}$ coal$^2$/nt m$^2$ d=distance between metals 1 and 2.

V=voltage difference between metals 1 and 2.

Q=charge in columbs.

For the deflection of a beam, $S_{\frac{1}{2}L}$ at the midpoint of its length under a concentrated load F where L=the length of the upper beam of metal 2.

$$S_{\frac{1}{2}L} = \frac{FL^3}{4EWh^3} \qquad \text{(B)}$$

where

F=Beam loading force

E=Youngs Modulus

W=width of line 2 h=height of line 2

L=length of line 2 suspended in free space.

For metal line 2 with w/h=1, L=10 μm, E=$10\times10^9$ Pa, h=1μ the following calculation will be performed for the force in (A) substituted into (B)

$$S_{\frac{1}{2}L} = \left(\frac{E_0A}{2}\ \frac{v^2}{d^2}\right)\frac{L^3}{4EWh^3} = \frac{E_0}{8}\ \frac{AL^3}{EWh^3}\left(\frac{v^2}{d^2}\right) \qquad \text{(C)}$$

Example: Using (c) and the following:

d=0.1 μm, L=10 μm, h=w=1 μm, A=(1 μm)$^2$, E=$10\times10^9$ Pa

We get $$S_{MAX} = \text{deflection at } \tfrac{1}{2}L \text{ of metal 2} = 1.1\times10^{-7}\ \frac{\text{meters}}{\text{volts}^2}\ (v^2) \qquad \text{(D)}$$

for 100 volts held between metals 1 and 2, metal 2 will flex and touch metal 1. This will cause a link to form between the two metals and provide a conductive path for charge. If the spacing is reduced to 500 Å, the programming voltage is reduced to 25 volts.

Although the above description of the forces involved relate deflecting one electrical contact toward the other, this description is also applicable in the case of repulsive forces which can be applied between the middle contact means and one of the adjacent contact means in the single pole double throw embodiment whereby the middle contact means is repulsed from the one adjacent contact means and deflected toward and into contact with the other adjacent contact means.

In addition, although the above description and the figures show electrostatic switches constructed on one level, it would be apparent to those of ordinary skill in the art as a result of this detailed description that switches can be formed at multiple levels over the substrate and such is considered to be within the scope and contemplation of the present invention.

While the present invention has been described with reference to specific embodiments thereof, it will be apparent to those skilled in the art that various changes and modifications may be made without departing from the invention it is broader aspects. It is contemplated in the appended claims to cover all variations and modifications of the invention that come within the true spirit and scope of my invention.

I claim:

1. A method of fabricating an electrostatic switch on a substrate comprising the steps of:

a) forming a first layer of electrically conductive material over a surface of said substrate;

b) forming said first layer of electrically conductive material into a first electrical contact means;

c) forming a layer of electrically insulating material over said first electrical contact means;

d) forming a second layer of electrically conductive material over said layer of electrically insulating material;

e) forming said second layer of electrically conductive material into a second electrical contact means having a predetermined spaced relationship with respect to said first electrical contact means; and f) creating a void in said layer of electrically insulating material between at least a portion of said first electrical contact means and said second electrical contact means.

2. The method in accordance with claim 1 wherein said substrate comprises a semiconductor substrate having electrical contact regions disposed therein, said method additionally comprising the steps of:

g) forming a first layer of electrically insulating material which is interposed between a surface of the semiconductor substrate and the overlying electrically insulating material;

h) forming at least one opening in said first layer of electrically insulating material to expose an underlying electrical contact region; and i) forming said first layer of electrically conductive material over said first electrically insulating layer into said opening and into electrical contact with said exposed electrical contact region.

3. The method in accordance with claim 2 wherein step i) comprises the steps of:

(j) forming a first adhesion layer over the first layer of electrically insulating material into said opening and into electrical contact with said exposed electrical contact region; and (k) forming a first electrically conductive layer over the first adhesion layer.

4. The method in accordance with claim 1 wherein step b) comprises forming said first layer of electrically conductive material into a first electrical contact means having a middle portion which is secured at least at each end to underlying structure; and wherein step e) comprises forming said second layer of electrically conductive material into a second electrical contact having a middle portion which overlies the middle portion of the first electrical contact means and which is secured at least at each end to said underlying second layer of electrically conductive material.

5. The method in accordance with claim 1 wherein step b) comprises forming said first layer of electrically conductive material into a first electrically contact means having a cantilevered middle portion which is secured at one end only to underlying structures; and wherein step e) comprises forming said second layer of electrically conductive means into a second electrical contact means having a middle portion which overlies said cantilevered middle portion of said first electrical contact means and which is secured at least at each end to said underlying layer of electrically insulating material.

6. The method in accordance with claim 1 additionally comprising, after step e), the steps of:

l) forming a second layer of electrically insulating material over said second electrical contact means;

m) forming a third layer of electrically conductive material over said second layer of said electrically insulating material;

n) forming said third layer of electrically conductive material into a third electrical contact means having predetermined space relationship with respect to the underlying first and second electrical contact means; and o) creating a void in said layer of electrically insulating material and said second layer of electrically insulating material between at least a portion of said first, second and third electrical contact means.

7. The method in accordance with claim 6 wherein said second electrical contact means has a middle portion which is secured at least at both ends thereof to said underlying layer of electrically insulating material.

8. The method in accordance with claim 6 wherein said second electrical contact means has a middle portion which is secured at only one end thereof to said underlying layer of electrically insulating material.

* * * * *